United States Patent [19]

Kircher

[11] 4,451,346

[45] May 29, 1984

[54] MEMBRANE-ELECTRODE PACK ALKALI CHLORINE CELL

[75] Inventor: Morton S. Kircher, Clearwater, Fla.

[73] Assignee: Olin Corporation, New Haven, Conn.

[21] Appl. No.: 276,763

[22] Filed: Jun. 25, 1981

Related U.S. Application Data

[63] Continuation of Ser. No. 128,684, Mar. 15, 1980, abandoned.

[51] Int. Cl.[3] ..... C25B 9/04; C25B 11/02; C25B 15/08; C25B 15/02

[52] U.S. Cl. ..... 204/228; 204/257; 204/263; 204/279; 204/289

[58] Field of Search ..... 204/252–253, 204/257–258, 265–267, 263–264, 279, 228, 289

[56] References Cited

U.S. PATENT DOCUMENTS

| | | | |
|---|---|---|---|
| 4,210,516 | 7/1980 | Mose et al. | 204/257 X |
| 4,211,627 | 7/1980 | Cunningham | 204/252 |
| 4,252,628 | 2/1981 | Boulton et al. | 204/257 |
| 4,256,562 | 3/1981 | Mose et al. | 204/258 |
| 4,285,793 | 8/1981 | Specht et al. | 204/279 X |

FOREIGN PATENT DOCUMENTS

| | | | |
|---|---|---|---|
| 2821979 | 11/1979 | Fed. Rep. of Germany | 204/267 |
| 54-9167 | 1/1979 | Japan | 204/257 |

*Primary Examiner*—Donald R. Valentine
*Attorney, Agent, or Firm*—Ralph D'Alessandro; Donald F. Clements; Thomas P. O'Day

[57] ABSTRACT

A novel commercial chlor-alkali electrolytic cell which has a pack of less than about 50 interleaved parallel planar electrode frames and substantially horizontal conductor rods. The pack is at least half and preferably twice as tall as it is thick.

10 Claims, 8 Drawing Figures

MEMBRANE-ELECTRODE PACK ALKALI CHLORINE CELL

This is a continuation of application Ser. No. 128,684, filed Mar. 10, 1980, now abandoned.

This invention relates to membrane-type electrolytic cells and particularly to monopolar cells.

Commercial cells for the production of chlorine and alkali metal hydroxides have been continually developed and improved over a period of time dating back to at least 1892. In general, chloralkali cells are of the deposited asbestos diaphragm type or the flowing mercury cathode type. During the past few years, developments have been made in cells employing ion exchange membranes (hereafter "membrane cells") which promise advantages over either diaphragm or mercury cells. It is desirable to take advantage of existing technology, particularly in diaphragm cells, but it is also necessary to provide cell designs which meet the requirements of the membranes. Since suitable membrane materials such as that marketed by E. I. duPont de Nemours and Company under the trademark Nafion ® and by Asahi Glass Company Ltd. under the trademark Flemion*tm* are available principly in sheet form, the most generally used of the membrane cells are of the "filter press" type. In the filter press type of cell, membranes are clamped between the flanges of filter press frames. Filter press cells are usually of the bipolar type. Bipolar filter press cells have been found to have serveral disadvantages. Bipolar filter press cells generally present the problem of making corrosion-free connections from anodes to cathodes through the separating plate. Bipolar filter press cells also have problems with preventing electrical leakage from one cell to another through inlet and outlet streams. Furthermore, bi-polar cell circuits designed for permissible safe voltages of about 400 volts are small in production capacity and are not economical for large commercial plants. The failure of one cell in a bank of bipolar filter press cells in usual practice requires shutting down the entire filter press back.

Filter press cells of monopolar design are not well known, probably because of the substantial practical problem of making electrical connections between the unit frames in the filter press and between one cell and the next. Tieing all of the anodes together with a single electrical bus and tieing all of the cathodes together with a single electrical bus interferes with drawing the frames together to form the seal between frames and membranes. On the other hand, use of flexible cables from cell to cell provides no way of removing one cell at a time from the circuit without interrupting the current on the entire circuit.

To illustrate the awkwardness of previous attempts to design monopolar membrane cells, reference is made to U.S. Pat. No. 4,056,458, by Pohto et al, issued Nov. 1, 1977, to Diamond Shamrock Corporation. The Pohto et al patent disclosed a cell which, like bipolar filter press cells, has the electrodes and end plates oriented perpendicular (see FIG. 8 of Pohto, et al) to the overall path of current flow through the cell. Specifically, Pohto et al discloses a central electrode assembly sandwiched between two end electrode assemblies, with membranes in between, to form a closed cell. A plurality of central electrode assemblies apparently may also be sandwiched in a similar manner. The end compartment and each of the center compartments of Pohto et al are flanged and maintained paired by gaskets and fasteners holding flanges in pairs. This type of cell may be practical for small units producing several hundred pounds of chlorine per day, but it is not economically practical for plants which produce several hundred tons per day. For example, Pohto et al discloses connecting the cells to bus bars in a system which would only be suitable economically on a small scale. Specifically, electrode rods extend from the cell tops. This includes rods of both polarities. If one tries to design such a bus system for a cell having a total current capacity of approximately 150,000 amperes which is a typical commercial cell current, the bus system will be found to be very large, cumbersome, and expensive.

The present invention, which will be referred to hereinafter as the "side-stack cell" for simplicity, eliminates many of the problems mentioned above by providing a monopolar membrane electrolytic cell which comprises:

- a plurality of vertical, hollow, foraminous, planar anode frames extending in a direction parallel to an overall path of current flow through said cell;
- a plurality of vertical, hollow, foraminous, planar cathode frames extending in said direction and alternatingly interleaved with said anodes;
- a plurality of sheets of cation exchange membrane material oriented in said direction, one of said sheets being pressed between each opposite pair of said anodes and cathodes;
- sealing means between each of said frames and said sheets;
- pressing means for pressing, transversely to said direction, said frames together in a pack against said membranes and sealing means so as to form a substantially fluid-tight cell;
- raw material supply conduits and product withdrawal conduits communicating with the interior of each of said hollow anode and cathode frames;
- a plurality of substantially horizontal anode conductor rods extending into said anode frames in said direction from a first side of said pressed pack;
- a plurality of substantially horizontal cathode conductor rods extending into said cathode frames in said direction from a second side, opposite to said first side, of said pressed pack;
- an anode terminal outwardly extending in said direction from said first side of said pack and a cathode terminal outwardly extending in said direction from said opposite second side of said pack;
- an anode current collector, adjacent said first side of said pack and oriented transversely to said direction for electrically connection said anode conductor rods to said anode terminal;
- a cathode current collector adjacent said opposite second side of said pack and oriented transversely to said direction for electrically connecting said cathode conductor rods to said cathode terminal;
- the total number of said anode and cathode frames in said pressed pack being within the range of from about 5 to about 50; and
- the ratio of thickness to height of said pressed pack being no more than about 2:1.

The side-stack cell provides several major advantages over existing membrane cells. Among the advantages of the invention is that the electrode elements and membranes are formed into a stack or "pack" bolted between end frames which support the pack to form a convenient unit with respect to capacity, floor space, and portability. Since the number of units in the pack are typically limited to less than about 50 problems with leakage or problems with deformation of connecting bus due to temperature changes which are serious with conventional filter press cells are virtually eliminated. Another advantage is that, in case of failure of a membrane, only a single cell including typically about 24 membranes can readily be removed for dismantling, repair and reassembly. This is more economical than either taking out an entire filter press assembly on the one hand or providing an expensive arrangement for replacing individual membranes on the other hand. Still another advantage is that since the anode and cathode structures of the present invention with substantially horizontal conductor rods permit an extraordinarily high cell, the intercell electrical connections provide, in combination with the substantially horizontal electrode conductor rods, a short direct current path through the circuit, thereby minimizing the amount of conductor material required for the cell and thereby minimizing voltage losses through the conductors of the cell. Yet another advantage of the present invention is that because of the simple electrical connection taking the cell of the invention out of service is relatively fast and simple.

Other advantages of the invention will become apparent upon reading the description below and the invention will be better understood by references to the attached drawings in which.

Figure 6:
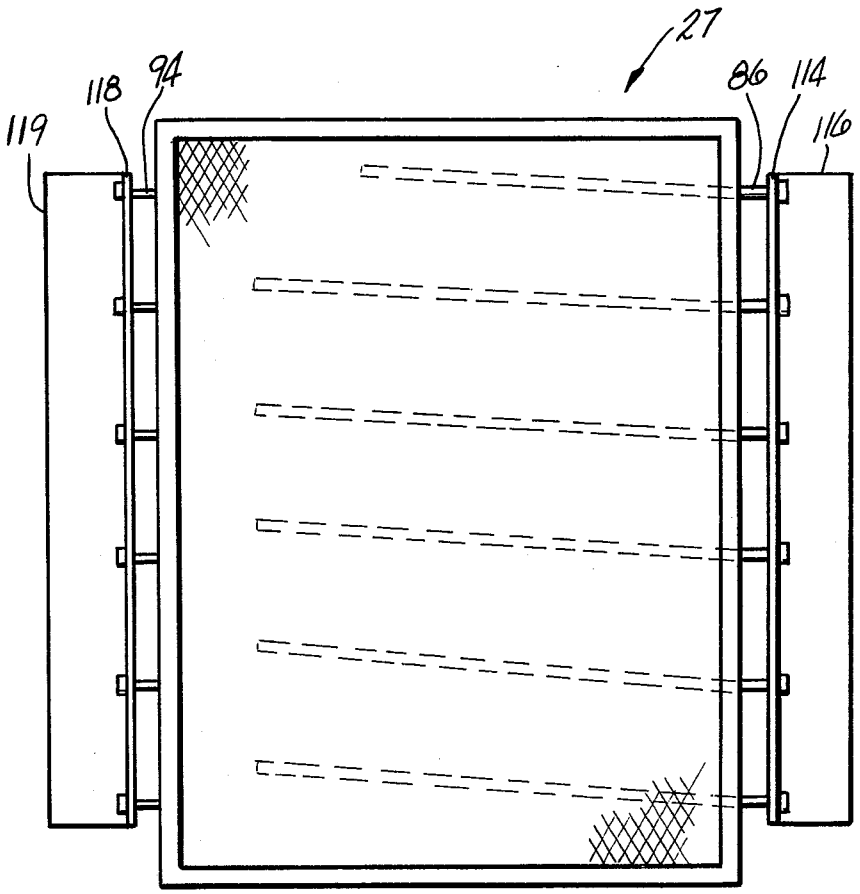
Figure 5:
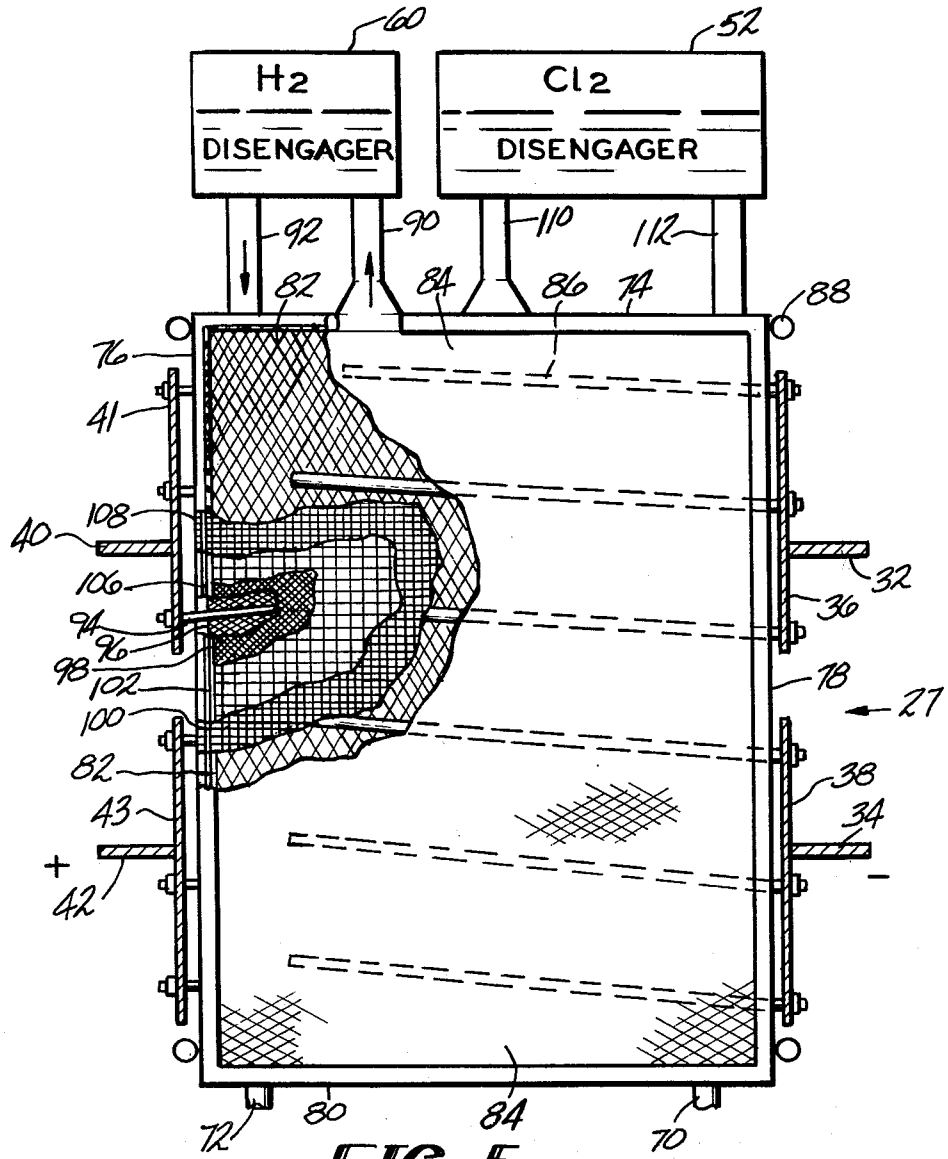
FIG. 5 is a vertical, cross-sectional rear view through the cell of FIG. 4 taken along line 5—5 of FIG. 4 showing an electrode frame thereof.
Figure 7:
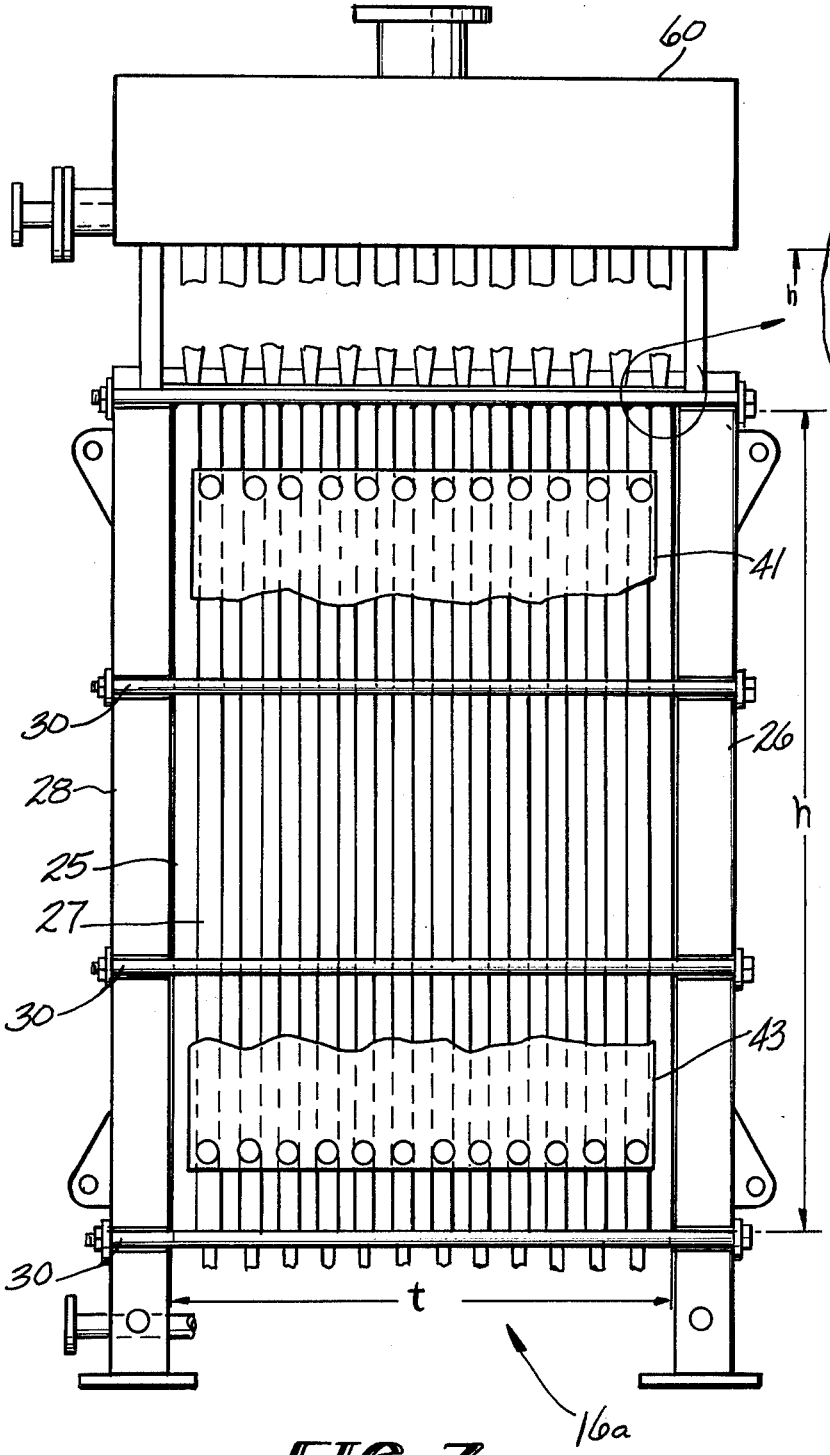
Figure 8:
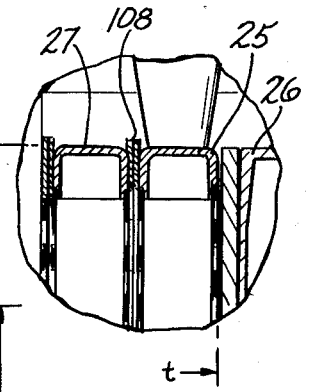

FIG. 6 which is identical to FIG. 5 except that the disengagers are omitted and the anode and cathode terminals are vertical rather than horizontal;

FIG. 7 is an elevational view of the electrochemical cell 16*a* from the anode end illustrating the dimension h representing the height of both the anode and the cathode frames and the dimension t representing the thickness of the pack 22 with some structural elements partially broken away to emphasize the structure forming the dimension h and t; and FIG. 8 is an enlarged elevational view of the circled portion of FIG. 7 with the tie bolt 30 of FIG. 7 removed showing the top of an anode frame 25, a cathode frame 27 and one of the end plates 26 to illustrate more clearly the limits of the dimensions h and t.

Figure 1:
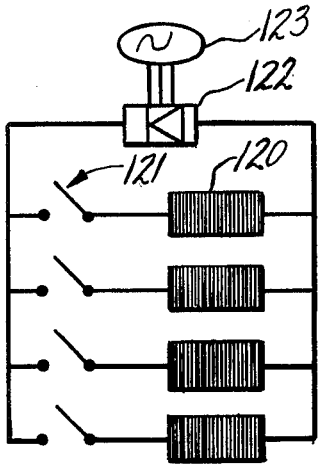
PRIOR ART FIG-1
FIG. 1 is a schematic view of a conventional prior art bipolar or monopolar filter press cell circuit.

FIG. 1 depicts a conventional filter press cell circuit which includes four filter press banks 120 connected in series with four electrical shut-off switches 121 and in parallel with a rectifier 122. Rectifier 122 is connected in conventional manner with a source 123 of alternating current of sufficient capacity to provide the desired current density through the cells of filter press banks 120. It will be noted that in the prior art filter press cell banks 120, the electrode frames are oriented perpendicular to the overall path of current flow through the cell banks. If one of the electrode frames or one of the membranes between the electrode frames is damaged and must be replaced, one switch 121 is opened to remove the particular bank 120 in which the damaged membrane or frame is located from the electrical circuit. This obviously shuts down one entire bank of frames so that no production is obtained from the disconnected cell bank 120 during the time the switch 121 associated with that cell bank 120 is open.

Figure 2:
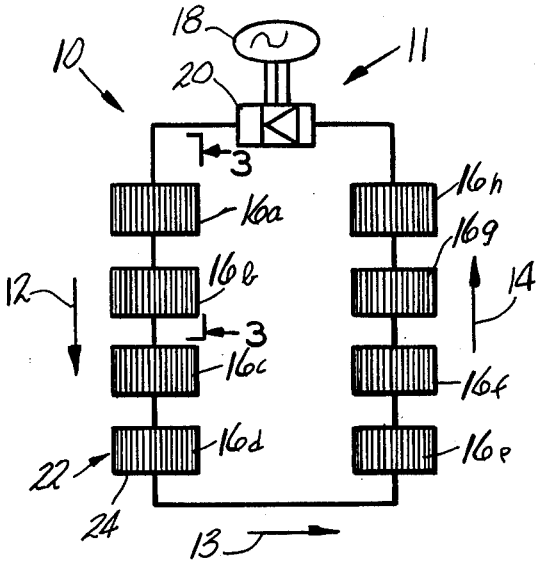
FIG. 2 is a schematic view of the monopolar electrical cell circuit of the invention showing, by way of example, eight preferred cells of the invention.

In contrast, the electrical circuit 10 shown in FIG. 2 comprises a DC power source 11 and electrical paths 12,13, and 14. Electrical paths 12 and 14 each include four electrical cells 16*a*, 16*b*, 16*c* and 16*d*, 16*e*, 16*f*, 16*g*, and 16*h*, respectively. There is no specific magic in the number four; rather, four cells are arbitrarily chosen by way of example. In a normal commercial chloralkali plant, there might reasonably be 100 or more cells per circuit rather than merely eight. In cell circuit 10, DC power source 11 would typically include a source 18 of alternating current and a rectifier 20. Each of the cells 16*a–h* is comprised of a pack 22 of electrode frames 24. Frames 24 are hollow, foraminous, planar and are oriented parallel to the overall direction of current flow through circuit 10. In particular, cells 16*a–d* are oriented with their respective frames parallel to path 12 while cells 16*e–h* are oriented with their respective frames parallel to path 14. As will be seen below in greater detail, this unconventional orientation of frames 24 provides a major technical advantage to circuit 10 in that the amount of conductor material required for circuit 10 is greatly reduced by such orientation.

Figure 3:
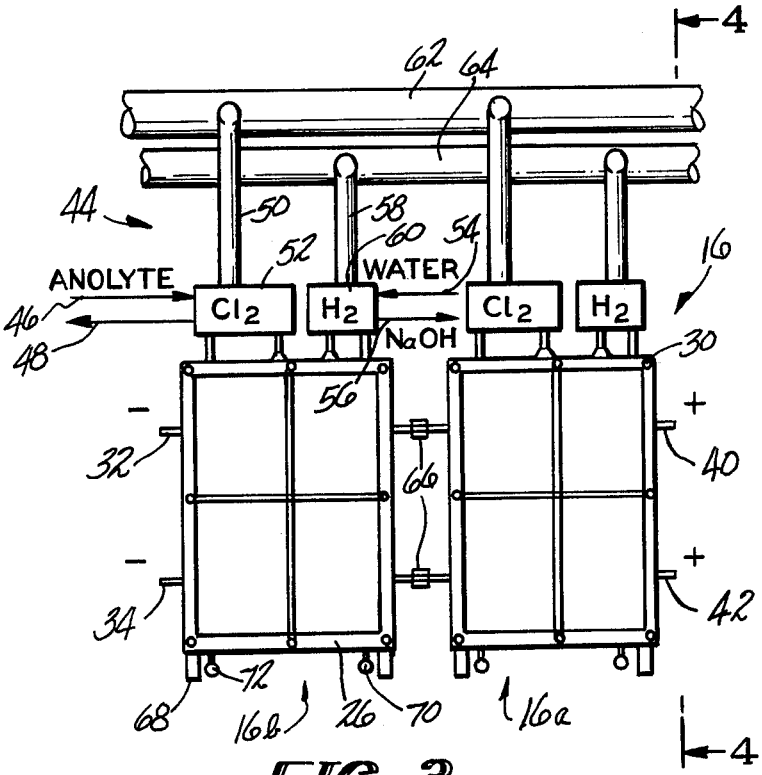
FIG. 3 is a front elevational view of two of the eight cells of FIG. 2, taken along line 3—3 of FIG. 2.
Figure 4:
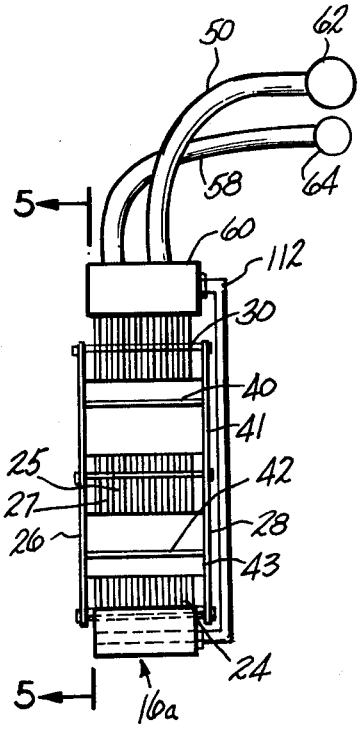
FIG. 4 is a side elevational view of one of the cells of FIG. 3 taken along line 4—4 of FIG. 3 and showing the anode side of that cell.

FIG. 3 is a front elevational view of cells 16*a* and 16*b* of circuit 10 of FIG. 2 taken along line 3—3. This view shows the anode terminals 40,42 of cell 16*a* on the right and cathode terminals 32,34 of cell 16*b* on the left. FIG. 4 is also a view of cell 16*a*, but instead taken along line 4—4 of FIG. 3 so as to show the anode side or end of cell 16*a*. Therefore, FIGS. 3 and 4 should be viewed together and the reference numbers in both FIG. 3 and FIG. 4 as well as FIGS. 2, 5, and 6 all refer to the same parts in all figures. Cells 16*a* and 16*b* each comprise a front end plate 26, a rear end plate 28, a plurality of interleaved anode frames 25, and cathode frames 27, a plurality of tie bolts 30, an upper anode terminal 40, a lower anode terminal 42, an upper anode collector 41, a lower anode collector 43, an upper cathode terminal 32, a lower cathode terminal 34, an upper cathode collector 36, lower cathode collector 38, and a material supply and withdrawal system 44. System 44, in turn, comprises a fresh brine supply conduit 46, spent brine withdrawal conduit 48, a chlorine outlet pipe 50, anolyte disengager 52, a water supply line 54, a caustic withdrawal line 56, a hydrogen outlet line 58, and a catholyte disengager 60. Chlorine outline line 50 and hydrogen outlet line 58 are connected, respectively, to chlorine line 62 and hydrogen line 64 which, in turn, lead to chlorine and hydrogen collection systems (not shown). Cells 16*a* and 16*b* are supported on support legs 68 and are connected to one another by an intercell connector 66. Cells 16*a* and 16*b* each are provided with a catholyte drain/inlet line 72 and an anolyte drain/inlet line 70. Lines 70 and 72 can be valved drain lines connected to each frame 24 in order to allow catholyte and anolyte to be drained from anodes, and cathodes, respectively. Alternatively, lines 70 and 72 can also be connected to disengager 52 and 60, respectively, in order to provide the recirculation path for disengaged anolyte and catholyte liquid. In the embodiment of FIGS. 3–5, lines 70–72 are connected in that manner to disengagers 52 and 60. In the event that lines 70 and 72 are merely drain lines, an internal "downcomer" pipe would be required from disengager 52 to each anode frame 25 and a separate "downcomer" would be required from disengager 60 to each cathode frame 27 in order to allow recirculation of anolyte and catholyte within cells 16*a* and 16*b*. Referring to FIGS. 2, 3, and 5, it is seen that the overall current flow path through cells 16*a* and 16*b* is from right to left in FIG. 3, from top to bottom in FIG. 2, and from left to right in FIG. 5. This current flow is best seen in FIGS. 3 and 5. In particular, current flows from anode terminals 40,42 to anode collectors 41,43 then to anode conductor rods 94 (see FIG. 5). From conductor rods 94, the current flows to a planar anode surface 96,98 and then through the anolyte, the membrane, and the catholyte to the surfaces 82,84 of cathode frames 27 and then to cathode conductor rods 86 (again see FIG. 5) and then to cathode collectors 36,38 and then onto cathode terminals 32,34. Cathode terminals 32 and 34 are connected by intercell connectors 66 to the anode terminals 40,42 of the next cell in the series of circuit 10. Thus, it is seen that current flows in a very straight and direct path through circuit 10 with the only transverse flow occurring through the actual inter-electrode gap. If an electrode frame or membrane of any one of cells 16*a–h* is damaged, it is a simple matter to bypass current around the cell containing the damaged frame or membrane while allowing the current to flow through the other seven cells. In this manner, a minimum amount of interruption in production results. In fact, a spare cell (not shown) is preferably available and could be substituted for any disconnected cell which was removed for repair.

FIG. 5 shows the preferred structural configuration of cathode frames 27. Each cathode frame 27 comprises top channel 74 and anode side channel 76, a cathode side channel 78 and a bottom channel 80 as well as a rear mesh surface 82 and a front mesh surface 84. The height of each frame 27 is at least half and preferably at least twice the thickness the pack 22. In other words, channels 76 and 78 are at least half and preferably twice as long the distance between end plates 26 and 28. FIGS. 7 and 8 best illustrate the height and thickness dimensions with h indicating the height dimension and t indicating the thickness dimension for the cell. A plurality of vertically spaced conductor rods 86 pass through and are supported by cathode side channel 78. A plurality of vertically spaced conductor rods 86 pass through and are supported by cathode channel 78. Rods 86 extend from collector plates 36, 38 substantially horizontally across the width of frame 27 and are slightly inclined at the end furthest from collector 36, 38 in order to direct hydrogen gas evolved by frame 27 toward an "upcomer" 90 leading to disengager 60 and to provide partial disengagement within the confines of frame 27, if desired. Rods 86 could also be horizontal, if desired, and could have the configuration described in U.S. Pat. Nos. 3,932,261, and 4,008,143 commonly assigned or the inclination disclosed in U.S. Pat. No. 3,963,596, also commonly assigned. Other substantially horizontal conductor rods configurations which encourage desirable gas flow patterns could also be utilized. Each cathode frame 27 also includes eyes 88 or some other alternative guide in order to allow frames 27 to be properly aligned with frames 25 and end plates 26 and 28 during assembly of the cells 16*a–h*. Top channel 74 is preferably of an inverted U-shape in order to better collect generated gases and direct the collected gases to upcomer 90. Upcomer 90 connects top channel 74 with disengager 60. In actual operation, the fluid flowing into and through upcomer 90, likely to be a "froth" or "foam" rather than a fully separated gas. However, if the design of rods 86 and frames 27 is such that partial separation can and does occur within the confines of frame 27, then top channel 74 may provide sufficient space to complete the disengagement of catholyte liquids from gases. Nevertheless, it is desirable to have a disengager 60 as a safety feature even it it is not normally needed. Disengager 60 is also fluidly connected to a downcomer 92 as previously noted. Downcomer 92 is preferably in fluid communication with catholyte drain inlet 72 or bottom channel 80 so that the disengaged liquid catholyte can be recirculated, if desired, to the bottom of each cathode frame 27.

FIG. 5 also shows, in cut away, the configuration of anode frames 25 (see FIG. 4). Anode frames 25 are generally similar in construction to cathode frames 27 and comprise top and bottom and two side channels. As with frames 27, frames 25 have a front mesh surface 96 and a rear mesh surface 98 which will electrically connect to anode terminals 40, 42 by anode conductor rods 96 and anode collectors 41, 43. Anode conductor rods 96 are inclined in similar fashion to cathode conductor rods 86. However, as with rods 86, rods 96 could be horizontal or offset, or both, if desired. An anolyte disengager 52 is connected to each anode frame 25 in similar fashion to the connection of disengager 60 to cathode frames 27. Therefore, a downcomer 112 and an upcomer 110 are provided to conduct fluids from and to disengager 52, respectively. Downcomer 112 is connected to anolyte drain/inlet line 70 in order to allow recirculation of anolyte within anode frames 25. Cathode surfaces 96,98 and anode surfaces 82 and 84 are separated by a membrane 100, and an anode spacer. In order to seal between each anode frame 25 and cathode frame 27, an anode gasket 106 is pressed between membrane 100 and the channels of anode 25 while a cathode gasket is pressed between membrane 100 and channels 74,76,78, and 80 of cathode frame 27. When bolts 30 (see FIG. 4) are tightened so as to press in plates 26 and 28 toward each other, gaskets 106 and 108 are pressed against the membranes and channels and the pack 22 (see FIG. 2) is thereby sealed against fluid leakage.

FIG. 6 shows a cathode frame 27 which is identical to cathode frame 27 as seen in FIG. 5 except that in FIG. 6 a vertical cathode collector plate 114 and a vertical cathode terminal 116 are substituted for collectors 36 and 38 and terminals 32 and 34 and vertical anode collector 118 and vertical anode terminal 119 is substituted for collectors 41,43 and terminals 40,42. The choice between vertical and horizontal terminals and collectors will depend upon the particular method and apparatus disconnecting the cells 16*a–h*, which is desired.

With the above detailed description in mind, modifications to the particular configuration will be seen to be within the scope of the invention as claimed below. The preferred embodiment disclosed above is merely provided by way of example and it is envisioned that modifications will be made without departing from the scope of the invention. It will be noted that, for example, the electrode frames are shown to be of picture-frame type configuration with four peripheral channels and two parallel, planar, mesh surfaces attached to the front and back of the frame. The channels could be replaced by tubes or bars. Single wall construction is preferred for the top channel in order to allow the top channel to serve as a gas collector. Preferably, this single wall top channel is reinforced at its open bottom to prevent bending, buckling, or collapse. The remaining channels could be of any suitable configuration which would allow the frames to be pressed together against a gasket in order to achieve a fluid-type cell. While a flat front and rear surface is shown for the channels, it would be possible to have many other configurations such as round or even ridged channels. The mesh is shown in FIG. 5 to be welded to the inside of the peripheral channels of the frame but could be welded to the front and back outside surfaces if the configuration of such outside surfaces did not interfere with gasket sealing when the mesh surfaces were on the outside rather than inside.

The cells 16*a–h* could be disconnected by the type of procedure disclosed in commonly assigned, commonly invented U.S. patent application No. 097,115, now U.S. Pat. No. 4,227,987. That application discloses use of a remotely operated jumper switch, bolt rotator, and hydraulic jack together with a slide-back type intercell connector in order to allow the cells to be positioned very close together and yet be safely and rapidly disconnected. In that procedure, a pair of conductor arms are closed together against both the cathode terminals 32,34 of the cell preceding the cell to be disconnected, and a separate pair of conductor arms are similarly closed or clamped against anode terminals 40,42 of the cell following the cell to be disconnected. The remotely operated bolt rotator is then positioned in an operative position adjacent bolts fastening the intercell connectors 66 between the cell to be disconnected and the preceding and following cells. The bolt rotator is then remotely actuated to loosen those bolts and a hydraulic jack is then inserted between the intercell connector and one of the cells and is remotely actuated to force the intercell connector out of engagement with the cell to be disconnected. A new cell is then substituted for the cell which has thus been disconnected and this new cell is reconnected by sliding the intercell connectors back into engagement with the new cell through use of the remotely operated jack and then tightening the engagement connector by use of the remotely operated bolt rotator. Following that operation, the remotely operated jumper switch can be disconnected. Other jumper switches and other disconnection procedures could be utilized to disconnect cells 16*a–h* within the scope of the invention. The advantage of the preferred disconnection method just described is that it enables the cells to be placed very close together even though they may be quite large and carry large current. This close spacing of the cells helps in realizing the objective of maximizing the amount of product that can be produced in a plant with a limited floor space.

The cathode frames are preferably built of nickel and the mesh surfaces on the cathode are also preferably made of nickel. The mesh surfaces are coated with a catalytic coating, such as Raney nickel, to reduce their hydrogen overvoltage to a very low level. There are several methods known for accomplishing such coating. One particularly desirable method is to apply a very thin coating through the use of a cathode sputtering procedure. The anodes are preferably dimensionally stable metal anodes made of titanium and the anode mesh surfaces are preferably titanium coated with a catalytic coating such as a mixed crystal of $TiO_2$-$RuO_2$. Procedures for applying such mixed crystal coatings are also well known. The spacers between the membrane and the mesh surfaces are preferably electrolyte-resistant netting having a spacing which is preferably about $\frac{1}{4}''$ in both the vertical and horizontal directions so as to effectively reduce the interelectrode gap to the thickness of the membrane plus two thicknesses of gasketing. The netting also restricts the vertical flow of gases evolved by the mesh surfaces and drives the evolved gases through the mesh and into the center of the hollow electrodes. That is, since the netting has horizontal as well as vertical threads, the vertical flow of gases is blocked by the horizontal threads and directed through the mesh surfaces of the electrode frames into the interior space of the electrode frames, i.e. the space within each frame between the mesh surfaces of that frame. With a $\frac{1}{4}''$ rectangular opening in the netting, the effective cell size in the interelectrode gap is reduced to about $\frac{1}{4}'' \times \frac{1}{4}''$. This reduced effective cell size allows the cell to be much higher than it could otherwise be because gases are not accumulated in the interelectrode gap but rather are forced through the electrode surfaces to the interior of the electrode. The use of horizontal conductor rods further assist in this gas flow pattern by creating limited restrictions within the space between mesh surfaces of each electrode so as to generate a venturi or low pressure effect which pulls the gases from the interelectrode gap through the mesh surfaces and into the interior of the electrodes. The horizontal conductor rods can further assist gas flow by altering the gas flow direction from vertical to substantially horizontal along the outside of the conductor rods, if desired. The conductor rods can thereby serve as gas directing channels which forces the gas to flow to one side of the frame so as to provide an efficient upward flow of gases within the frames.

Many other similar modifications will also be apparent, and it is, therefore, easily recognized that the invention claimed below should be entitled to full range of equivalence.

What is claimed is:

1. A monopolar membrane electrolytic cell connected as one of a predetermined number of adjacently positioned electrolytic cells in an electrical series circuit, said cell comprising:

a plurality of vertical, hollow, foraminous, planar anode frames extending in a direction parallel to an overall path of current flow through said cell;

a plurality of vertical, hollow, foraminous, planar cathode frames extending in said direction and alternating interleaved with said anodes;

a plurality of sheets of cation exchange membrane material oriented in said direction, one of said sheets being pressed between each opposite pair of said anodes and cathodes;

sealing means between each of said frames and said sheets;

pressing means for pressing, transversely to said direction, said frames together in a pack against said membranes and sealing means so as to form a substantially fluid-tight cell;

raw material supply conduits and product withdrawal conduits communicating with the interior of each of said hollow anode and cathode frames;

a plurality of substantially horizontal anode conductor rods extending into said anode frames in said direction from a first side of said pressed pack;

a plurality of substantially horizontal cathode conductor rods extending into said cathode frames in said direction from a second side, opposite to said first side, of said pressed pack;

an anode terminal outwardly extending in said direction from said first side of said pack;

a cathode terminal outwardly extending in said direction from said opposite second side of said pack;

an anode current collector adjacent said first side of said pack and oriented transversely to said direction connected to said plurality of anode frames and said anode conductor rods thereby electrically connecting said anode conductor rods to said anode terminal;

a cathode current collector adjacent said opposite second side of said pack and oriented transversely to said direction connected to said plurality of cathode frames and said cathode conductor rods thereby electrically connecting said cathode conductor rods to said cathode terminal;

first intercell connector means connecting said anode terminals of said cell with the cathode terminals of a first of said adjacently positioned electrolytic cells and second intercell connector means connecting said cathode terminals of said cell with the anode terminals of a second of said adjacently positioned cells, said first and second intercell connector means being connected to said adjacently positioned cells in a manner that permits the electrical current to be rapidly and safely disconnected to remove said cell from the series circuit;

the total number of said anode and cathode frames in said pressed pack being within the range of from about 5 to about 50; and the ratio of thickness of said pressed pack to the height of said cathode and anode frames being no more than approximately 2:1 thereby facilitating disconnecting said first and second intercell connector means between the adjacently positioned electrolytic cells.

2. The monopolar membrane electrolytic cell of claim 1 wherein the ratio of thickness of said pressed pack to the height of said cathode and anode frames is no less than approximately 1:2.

3. The monopolar cell of claim 1 wherein said anode and cathode terminals extend from said first and second sides of said pack in a horizontal plane.

4. The monopolar cell of claim 3 wherein there are at least two separate vertically aligned, horizontal cathode and anode terminals extending from said first and second sides of said pack.

5. The monopolar cell of claim 1 wherein said anode and cathode terminals are oriented perpendicular to said anode and cathode current collectors respectively.

6. The monopolar cell of claim 1 wherein said anode and cathode terminals are oriented in a vertical plane.

7. The monopolar cell of claim 6 wherein there are at least two vertical cathode terminals and at least two vertical anode terminals extending from said first and said second side of said pack, respectively.

8. The monopolar cell of claim 6 wherein the anode and cathode current collectors are oriented in a vertical plane transverse to said direction.

9. The monopolar cell of claim 8 wherein there are at least two vertical anode and cathode terminals extending from said first and second sides of said pack, respectively.

10. A cell circuit comprising at least two of the monopolar cells of claim 1 connected in electrical series.

* * * * *